United States Patent [19]

Kropac

[11] 3,964,904

[45] June 22, 1976

[54] MANIFOLD IMAGING MEMBER AND PROCESS EMPLOYING A DARK CHARGE INJECTING LAYER

[75] Inventor: Joseph M. Kropac, Williamson, N.Y.

[73] Assignee: Xerox Corporation, Stamford, Conn.

[22] Filed: Aug. 22, 1974

[21] Appl. No.: 499,683

[52] U.S. Cl. ..... 96/1.5; 96/1 M; 96/1.8

[51] Int. Cl.[2] ..... G03G 5/00; G03G 13/00; G03G 17/00

[58] Field of Search ..... 96/1 M, 1.5, 1 PE, 1 PS

[56] References Cited

UNITED STATES PATENTS

| | | | |
|---|---|---|---|
| 3,394,001 | 7/1968 | Makino | 96/1.5 |
| 3,512,968 | 5/1970 | Tulagin | 96/1.2 |
| 3,565,612 | 2/1971 | Clark | 96/1 M |
| 3,573,904 | 4/1971 | Clark | 96/1 M |
| 3,573,906 | 4/1971 | Goffe | 96/1.5 C X |
| 3,598,581 | 8/1971 | Reinis | 96/1.5 |
| 3,653,885 | 4/1972 | Levy et al. | 96/1 PS |
| 3,704,121 | 11/1972 | Makino et al. | 96/1.5 X |
| 3,707,391 | 12/1972 | Goffe | 96/1 PS X |
| 3,723,113 | 3/1973 | Goffe | 96/1 PS X |
| 3,740,216 | 6/1973 | Goffe | 96/1 PS |
| 3,741,757 | 6/1973 | Goffe | 96/1 PS |
| 3,741,758 | 6/1973 | Chrzanowski et al. | 96/1 PS |
| 3,753,706 | 8/1973 | Sankus et al. | 96/1 PS |
| 3,769,010 | 10/1973 | Hanada et al. | 96/1.5 |
| 3,791,822 | 2/1974 | Goffe | 96/1 PS |
| 3,791,826 | 2/1974 | Cherry et al. | 96/1.5 |
| 3,824,099 | 7/1974 | Champ et al. | 96/1.5 |
| 3,836,364 | 9/1974 | Lin | 96/1 PS X |
| 3,837,851 | 9/1974 | Shattuck et al. | 96/1.5 |
| 3,839,031 | 10/1974 | Sankus et al. | 96/1 PS |
| 3,839,034 | 10/1974 | Wiedemann | 96/1.5 |
| 3,850,630 | 11/1974 | Regensburger et al. | 96/1.5 |
| 3,861,913 | 1/1975 | Chiou | 96/1.5 |
| 3,865,798 | 2/1975 | Radler et al. | 96/1.5 |
| 3,876,445 | 4/1975 | Goffe | 96/1 PS X |

FOREIGN PATENTS OR APPLICATIONS

| | | | |
|---|---|---|---|
| 763,540 | 8/1972 | Belgium | 96/1.5 |
| 44-12389 | 6/1969 | Japan | 96/1.5 |

OTHER PUBLICATIONS

Dessauer et al., *Xerography*, 1965, pp. 101–117.

B327,363, Jan. 1975, Bean, 96/1 PS X.

*Primary Examiner*—David Klein

*Assistant Examiner*—John R. Miller

[57] ABSTRACT

A manifold member and method is disclosed wherein the imaging layer is activated by a thermo-activator which is incorporated integrally into the manifold imaging layer. The member also contains a dark charge injecting material. Upon heating, the thermo-activator activates the imaging layer for use in the manifold imaging process.

16 Claims, No Drawings

MANIFOLD IMAGING MEMBER AND PROCESS EMPLOYING A DARK CHARGE INJECTING LAYER

BACKGROUND OF THE INVENTION

This invention relates to the manifold imaging process and more particularly to a novel thermally activated imaging member and method.

There has been discovered an imaging technique generally referred to as the manifold imaging method wherein an imaging member comprising a donor layer, imaging layer and receiver layer is employed. The imaging layer is electrically photosensitive and in one form comprises an electrically photosensitive material such as metal-free phthalocyanine dispersed in an insulating binder. Typically, the imaging layer is coated on the donor layer and the coated substrate combined is termed a donor. When needed, in preparation for the imaging operation, the imaging layer is activated as by contacting it with a swelling agent, softening agent, solvent or partial solvent for the imaging layer. The imaging layer is typically exposed to an imagewise pattern of light to which it is sensitive and, while sandwiched between the donor and receiver layers, subjected to an electric field. The imaging layer fractures upon the separation of the donor and receiver layers while subjected to an electric field providing complementary positive and negative images on the donor and receiver layers in accordance with the image to which it was exposed.

Such manifold imaging method is more fully disclosed in U.S. Pat. No. 3,707,368 to Van Dorn which patent is hereby incorporated by reference. As is taught in said patent the imaging layer is typically activated by applying thereto an activator material. Subsequent efforts in the manifold imaging science has produced other methods of activation such as thermo-activation as disclosed in U.S. Pat. No. 3,598,581 to Reinis which patent is hereby incorporated by reference. Although activation as disclosed by Reinis eliminates the need for handling liquid activators at the imaging site, such process provides a wax component on the final image and a carryover in image background areas. In addition, the Reinis imaging member contains a separate layer of thermo-activator over the imaging layer. Thus, an additional coating step is needed requiring great care so as not to damage the imaging layer in those instances wherein the thermo-activator is not coated on the receiver layer. Images produced by such processes contain the thermo-activator on the image and background areas. There is desired a thermo-activator method which reduces the amount of wax on the image and background areas.

The result of other work related to thermo-activation of a manifold imaging layer is described in copending U.S. application Ser. No. 210,658 filed Dec. 22, 1971. The problem of wax carry-over in image background areas is reduced according to said copending application by placing the hot melt coated thermo-activator layer under the imaging layer rather than over it as disclosed in the Reinis patent. While such method reduces the amount of activator carry-over in background areas on the receiver there has been found several narrow process parameters such as coating thickness and activator temperature for optimum image quality. Again, an additional coating step is necessary to provide the separate layer of thermo-activator in the imaging member.

SUMMARY OF THE INVENTION

It is, therefore, an object of this invention to provide an improved manifold imaging method.

Another object of this invention is to provide a novel imaging member useful in the manifold imaging process having a thermo-activation capability incorporated into the imaging layer.

Another object of this invention is to provide a thermo manifold imaging process which provides images having reduced activator in background areas.

Another object of this invention is to provide a thermo-activated manifold imaging member which requires fewer coating steps to produce the imaging member.

In accordance with the invention there is provided a manifold imaging member and method employing an integral imaging layer comprising electrically photosensitive material and a thermo-activator in a binder. The imaging layer is employed in the manifold imaging process by coating it onto a donor layer and exposing the layer to electromagnetic radiation to which it is sensitive while the layer is subjected to an electric field. The imaging layer is activated by heating the layer thus rendering the layer cohesively weak such that it fractures in response to the combined effects of the exposure to electromagnetic radiation to which it is sensitive and the electric field. While sandwiched between a donor and a receiver layer and subjected to an electric field the imaging layer, when so activated, fractures in imagewise configuration upon the separation of the donor and receiver layers.

The imaging layer of this invention is prepared in any suitable manner whereby the thermo-activator is uniformly dispersed throughout the layer. In most instances it has been found convenient to first combine the thermo-activator with the binder materials and subsequently combining this mixture with the electrically photosensitive materials. Thus, a thermo-activator is added to the binder materials for the imaging layer in any suitable amount such that, upon heating, the layer is rendered fracturable as described above.

Depending upon the choice of binder materials employed the amount of thermo-activator will vary. The amount generally found to be useful is in the range of from about 15% to about 40% by weight of the binder materials to be included in the imaging layer. For materials most usually available, amounts of thermo-activator in the range of from about 25% to about 35% have been found useful and generally about 30% is preferred.

In preparing the imaging layers of this invention it has been found that certain solvents employed in the prior art of manifold imaging, including the prior art of thermo-activation, cannot be employed effectively in the practice of this invention. In particular it has been found that aliphatic nonpolar solvents such as kerosene and other low boiling aliphatic hydrocarbon solvents cannot be employed in the practice of this invention to produce satisfactory images. Such solvents, if employed during the preparation of the imaging layer must be removed from the imaging layer before coating the material on the donor layer. Most typical of the prior art solvents which are not employed in the imaging layers of this invention is a kerosene fraction commercially available under the trade name Sohio 3440 from The Standard Oil Company. While not advancing any theory as to why such solvents cannot be employed they tend to cause high background in the images produced.

Also in accordance with this invention the quality of the images produced are seen to be greatly improved by the incorporation into the imaging member a dark charge injecting material. Such material is incorporated into the member so as to be in contact with the imaging layer. In one embodiment, a thin coating of such material is placed on one of the donor and receiver layers. Dark charge injecting materials are those materials which are capable of injecting a uniform charge of one polarity into an electrically photosensitive layer on contact while under an electric field in the dark, that is, while neither materials is exposed to electromagnetic radiation to which it is sensitive. Such materials generally contain electron withdrawing groups such as $NO_2$, C ≡ N, C=C, etc. and typically include: Gantrez VC a poly(alkyl vinyl ether/vinyl chloride) polymer from General Anline & Film Corp., Polyvinyl Chloride (PVC resins) sold as "Rust Veto" from E. F. Houghton & Co., other vinyl chlorides such as Geon 121 and Geon 126 from B. F. Goodrich, and PVC CR80A from Diamond Alkali Co., Gantrez AN-8194 which was hydrolized to poly(octodecyl vinyl ether/maleic acid) and obtained as poly(octodecyl vinyl ether/maleic anhydride) from General Anline & Film Corp., Fluropolymer B, which is a DuPont terepolymer of vinylidine Fluoride/tetrafluroethylene/vinyl ester, Kynar 201 which is a vinylidene fluoride from Pennalt Chem. Co., polyvinyl acetates such as Elvax 420 from DuPont, and P 9009, KG-38 from Allied Chemical Co.

Such materials can be incorporated into the imaging member by coating, preferably on the receiver layer, by means of solvent coating wherein the material is dissolved in a solvent and the solution coated by any conventional means onto the donor or receiver layer. The solvent is then evaporated away leaving a thin coating of the material on the layer.

DETAILED DESCRIPTION OF THE INVENTION

But for the exceptions noted above, the manifold imaging materials in the prior art employing thermo-activated imaging layers are also useful in the member and process of this invention. Thus, typical thermoplastic, metal and paper donor and receiver layers of the prior art are also useful herein. In addition the typical electrically photosensitive imaging materials of the prior art are employed herein.

Typical electrically photosensitive materials include organic as well as inorganic materials. Because of its sensitivity a preferred organic material is the x crystalline form of metal-free phthalocyanine. Other forms of phthalocyanine are useful as well as substituted phthalocyanines well known in the art. Other organic materials include quinacridones, nitriles, imidazoles, triazines and pyrazolines as are known in the prior art. Inorganic materials include zinc oxide, mecuric sulfide, cadmium sulfide, zinc sulfide arsenic sulfide and various selenides. Organic materials, including some of those listed above are preferably, complexed with small amounts (up to about 5%) of Lewis acids which are well known in the art. Numerous other exemplary materials useful in the preparing the donor, receiver and imaging layers are listed in the above incorporated U.S. Pat. No. 3,707,368.

Here, as in the prior art, the thermo-activator to be employed is chosen so as to effect the desired activation of the imaging layer keeping in mind the electrically photosensitive materials and binders employed therein.

Typical binder materials include electrically insulating resins such as polyethylene, polypropylenes, polybutylene, polyamides, polymethacrylates, epoxies, phenolics, hydrocarbon resins and natural resins such as rosin derivatives as well as mixtures thereof. Other binders materials of the prior art as described in the above mentioned Van Dorn patent can also be employed.

An advantage provided by the instant invention is the control over activator carry-over onto the image and background areas of the receiver. In accordance with this invention, the amount of activator left on the complementary images is concentrated on one image while the other image has relatively less activator. The imaging system is thus operated so as to take advantage of the control over activator carry-over. Activator carry-over is further controlled by the addition of small amounts of microcrystalline wax to the thermo-activator. Amounts up to about 4% by weight of the thermo-activator provide images wherein most of the activator is left on one image thus reducing the amount of activator on the other image. Any suitable microcrystalline wax can be employed. A typical microcrystalline wax is Paraflint RG available from the Moore and Munger Co.

In another embodiment of this invention the dispersion also contains sub-microscopic hydrophobic silica. Any suitable hydrophobic finely divided silica can be employed, such silica is commercially available under various tradenames and generally has a particle size in the range of from about 2 to about 30 millimicrons. Examples of such silicas are Silanox 101 and Organo-Sil available from the Cabot Chemical Company, Boston, Massachusetts and Aerosil R-972 available from Degussa Inc., New York, N. Y. Other similar gel forming silica products can be employed in accordance with this invention. Hydrophobic silica is a specially prepared produce from silicon dioxide. A more complete description as several exemplary materials is found in U.S. Pat. No. 3,720,617 to Chaterji et al, which patent is hereby incorporated by reference.

The above described silica forms a gel with the thermo-activator and the gel is incorporated into the imaging layer together with the thermo-activator. Typically, the gel is provided by first mixing the thermo-activator in its melted, liquid state with an appropriate amount of silica as indicated above. The silica is added to the activator preferably with constant stirring. Only a small amount of silica is desirable in the imaging layer of this invention. An amount of from about 0.1% to about 5% has been found to be useful and preferably about 2% by weight of the thermo-activator is employed. The melted activator/silica mixture is precipitated in a non-solvent which, conveniently, is an alcohol. Typical alcohols whether employing silica or not, include ethanol, isopropanol, methanol, and other low molecular weight alcohols. The alcohol is preferably anhydrous. The precipitate is then milled to provide a dispersion of suitable particle size in the alcohol than coated from the dispersion onto either donor layer, imaging layer or receiver layer. The activator layer can be dried slowly at room temperature or the coating is heated to drive off the alcohol.

When employing elevated temperatures to remove high concentration of methanol after coating, care must be taken to avoid an alcohol-wax gel formation. In order to reduce the tendency of forming such a gel, a mixture of alcohols is employed to produce the dispersion. For example a 50/50 mixture, by weight, of ethanol and isopropanol can be employed at drying temperature in the range of from about 52°C to about 80°C. Partial air drying at room temperature greatly reduces the tendency of such gel formation. More preferably a mixture of 5% methanol, 5% isopropanol and 90% ethanol, by weight, provides acceptable drying temperatures. These and other mixtures can be employed to combine the best balance of quality between a dispersion medium and drying speed.

Typical prior art thermo-activators, or solvents include those known in the prior art. The term "thermo-activator" or "thermosolvent" is intended to mean those materials which have a melting point lower than the imaging layer which, upon melting, become an activator for the imaging layer. That is, the activator material structurally weakens or reduces the cohesive strength of the imaging layer such that the layer fractures in response to the combined effects of an applied electric field and exposure to electromagnetic radiation to which the layer is sensitive. In such weakened condition the layer cleaves or fractures in accordance with the imagewise exposure when the donor and receiver layers are separated. The amount of activator depends upon several factors such as the imaging layer material, thickness of the imaging layers and the ability of the activator to soften or weaken the imaging layer. The amount of activator is held to the minimum amount required for adequate activation.

Particularly preferred thermo-activators are those which are solid at or slightly above room temperature but which melt below 175°F. Such thermo-activators include long chain petroleum waxes with from about 16 to about 37 carbon atoms in the chain. Typical waxes include hexadecane, heptadecane, octadecane, nonadecane eicosane, heneicosane, docosane, tricosane, tetracosane, pentacosane, octacosane, triacentane, dotriacontane, tetratriacontane, and octatriacontane and mixtures thereof. Other thermo-activators known in the art include m-terphenyl, Aroclors (chlorinated polyphenyls available from Monsanto Co., St. Louis, Mo.), biphenyl, polybutenes and mixtures thereof.

In addition to silica, as described above, small amounts of a metal soap such as zinc stearate have been found to be useful in providing better image quality in accordance with this invention. Such material is added to the thermo-activator in the hot melt state as described above with respect to the silica. Amounts of metal soap found to be useful are in the range of from about 1% to about 3% based upon the weight of the thermo-activator.

The thermo-activator of this invention can be combined with the other ingredients of the imaging layer in any suitable manner. One convenient method is to first melt the thermosolvent and add to the melted material the binder materials for the imaging layer. The entire mixture is then permitted to cool resulting in a paste-like precipitate. If it is desired to add any silica or metal soap these materials are also added to the hot melt. The paste-like precipitate is then combined with the electrically photosensitive material and uniformly mixed by any suitable known method such as by ball milling or through the use of an attritor. In another method, a solvent including any typical organic, non-polar solvent such as napthlene, heptane, decane, etc. is employed to dissolve the binder materials or to swell those which are insoluble. To the solution is added the thermosolvent which may contain silica or metal soap added as described above. The entire mixture is then precipitated in a polar solvent and thoroughly mixed by any suitable mixing method to provide a uniform mixture. The premilled electrically photosensitive materials is to the mixture and dispersed by such means as ball milling.

In all cases the non-polar solvent is removed from the mixture prior to its being coated onto a donor layer. Any suitable coating method known in the prior art can be employed to coat the imaging material of this invention onto a donor layer. A preferred method is a wire wound drawdown rod.

DESCRIPTION OF THE PREFERRED EMBODIMENTS

The following examples further specifically illustrate the various embodiments of the improved imaging member and method. The parts and percentages are by weight unless otherwise indicated.

EXAMPLES I & II

An imaging layer is prepared by first mixing 2.5 grams of x-form metal-free phthalocyanine with about 1.2 grams of Algol Yellow 2 BLT, 1,2,5,6-di(C,C -diphenyl) thiazoleanthraquinone, C. I. No. 67300, available from GAF and about 2.8 grams of purified Irgazine 2 BLT available from Geigy Chemical Co. The mixture is milled in a ball mill with ½ to ⅝ inch flint stones for 4 hours with 60 ml of a hydrocarbon solvent available under the trade name DC Naphtha 2032 from The Standard Company of Ohio, Cleveland, Ohio.

A binder is prepared by first dissolving 20 parts (Example I) and 30 parts (Example II) of paraffin wax available from the Wil Scientific Co., Roch., N.Y. under the trade name Bioloid Embedding Compound, 3 parts of Polyethylene DYLT, 1.5 parts of Paraflint RG, 0.5 parts of Elvax 420 in 70 ml. of isopropal alcohol by heating the mixture with stirring. The solution was allowed to cool and the resulting paste added to the milled pigment. The pigment/paste mixture is ball milled for about 16 hours. The milled paste is then placed in a polyethane jar, heated in a water bath at a temperature of 65°C for about 2 hours, allowed to cool and slurried in about 70 parts of 2-propanol. The paste-like mixture is then coated on 1 mil donor of Mylar (a polyester formed by the condensation reaction between ethylene glycol and terephthalic acid available from E. I. DuPont de Nemours & Co. Inc.) with a No. 22 wire-wound drawdown rod to produce a coating thickness when dried of approximately 8 to 10 microns averaging about 0.21 grams of imaging material per square foot. The coating on the 1 mil Mylar sheet is then dried in the dark at a temperature of about 65°C for 10 minutes.

A 1 mil Mylar receiver is placed on a grounded electrode heated to 55°C in each instance. The donor, with imaging layer towards the receiver is placed on the heated receiver. The activator melts and the sandwich is charged by passing a 8.5KV corona discharge device over it. After charging, the imaging layer is exposed to an imagewise pattern of incandescent light at a total energy of 0.30 foot candle seconds. While heated, the donor and receiver layers are separated providing a positive image of the original on the donor layer and a negative image on the receiver. In Example I the image on the receiver has low background while both images of Example II have high background.

minutes at 65°C. Each donor thus produced is imaged as in Example I but with the amount of light inicated in Table I and with a receiver layer coated as described in Example II.

TABLE I

| Example | IV | V | VI | VII | VIII | IX | X | XI | XII | XIII | XIV |
|---|---|---|---|---|---|---|---|---|---|---|---|
| Polyethylene DYLT | 3.0 | 3.0 | 3.0 | 3.0 | 3.0 | 3.0 | 3.0 | 3.0 | 3.0 | 3.0 | 3.0 |
| Piccotex 75 | 2.5 | 2.5 | 2.5 | 2.5 | 2.5 | 2.5 | 2.5 | 2.5 | 2.5 | 2.5 | 2.5 |
| Paraflint RG | 1.5 | 1.5 | 1.5 | 1.5 | 1.5 | 1.5 | 1.5 | 1.5 | 1.5 | 1.5 | 1.5 |
| Elvax 420 | .5 | .5 | .5 | .5 | .5 | .5 | .5 | .5 | .5 | .5 | .5 |
| Bioloid Embedding Wax | 43 | 43 | 43 | 43 | 43 | 43 | 43 | 43 | 43 | 43 | 43 |
| Silica | .14 | .70 | 1.40 | | | .1 | .5 | 1 | | | |
| Metal Soap | | | | .20 | 1 | | | | .014 | .14 | .70 |
| Isopropal Alcohol — ml. | 70 | 70 | 70 | 70 | 70 | 70 | 70 | 70 | 70 | 70 | 70 |
| DC Naphtha — ml. | | | | | | | 20 | 20 | 20 | 20 | 20 |
| Draw Down Rod No. | 22 | 30 | 22 | 22 | 22 | 22 | 30 | 30 | 30 | 30 | 22 |
| Light Exposure — f.c.s. | 0.27 | 0.2 | 0.18 | 0.24 | 0.35 | 0.39 | 0.19 | 0.19 | 0.39 | 0.36 | 0.33 |

EXAMPLE III

The procedure of Example II is repeated with the exception that the receiver layer is first coated with a dark charge injection material as follows: The receiver is first coated by means of a solvent coating, with a thin layer of Dow electroconductive resin available from Dow Chemical Co. under the trade name ECR 34. Over the conductive resin is coated, by solvent coating means, a thin layer of vinyl chloride, vinyl alkyl ether copolymer available from General Aniline and Film Co. under the trade name Gantrez VC. The coating is dried at 60°C for 10 minutes. The conductive coating of ECR 34 is employed as one of the electrodes in the process. Upon separation of the donor receiver sheets an excellent image is found on the receiver sheet.

EXAMPLES IV-XV

The milled electrically photosensitive materials of Example I are added to the binder materials in parts by weight as indicated in Table I. In Examples IV – IX the binder materials and photosensitive materials are combined in the melted paraffin wax and the entire mixture is precipitated by cooling. All of the combined materials are then ball milled as in Example I. Immediately prior to coating onto 1 mil thick Mylar film, isopropal alcohol is added to the mixture. In Examples X – XV the binder materials are dissolved in hot DC Naphtha 2032, precipitated by cooling and combined with the photosensitive materials by ball milling with flint stones overnight. Separately, the paraffin wax is melted and any additive such as silica in the form of Aerosil R972 or metal soap in the form of zinc stearate is added to the hot melt. The wax mixture is then precipitated in isopropal alcohol and milled for 96 hours in a ball mill with flint stones. The milled wax mixture is then combined with the pigment/binder mixture and ball milled for 1 hour with ½ to ⅝ inch flint stones.

In all cases the imaging material is coated onto 1 mil thick Mylar film by means of a wire wound draw down rod as indicated in Table I. The coatings are dried at 10

Examples VII – XI appear to provide smoother coatings than those of Examples IV – VI. Examples VIII and IX exhibit coatings of increasing smoothness. Upon separation of the donor and receiver layers after exposure excellent negative images are found on the receivers of Examples VIII and IX.

EXAMPLES XV–XX

In each of the following examples the electrically photosensitive materials are prepared as in Example I. The binder materials are dissolved in the hot solvent, precipitated by cooling before being combined with the electrically photosensitive materials. The binder/pigment mixture is milled with flint stones overnight after which the mixture is heated to 65°C for 10 minutes and then cooled.

Separately, the wax is combined with additives, if any, while the wax is melted. The wax with additive, if any, is precipitated in isopropal alcohol and milled to disperse the additive for 50 hours with flint stones. The milled wax is then combined with the pigment/binder mixture with additional ball milling of from 30 – 45 minutes to assure uniform distribution of all components. In all of the examples the imaging material is coated on a 1 mil Mylar donor layer by means of a wire wound draw down rod as indicated below in Table II and dried at 60°C for 15 minutes. In each example the receiver layer is coated with the dark charge injecting material as was the donor layer of Example III. In all examples except Example XVII the electrically photosensitive material of Example I is combined with the binder materials as listed below in Table II. In Example XVII the organic solvent employed in milling the pigments comprises 30 ml of DC Naphtha 2032 and 30 ml of isopropyl alcohol. In all cases the imaging layer is activated by heating the layer to above 56°C. In Table II all parts are parts by weight unless otherwise indicated.

TABLE II

| Example | XV | XVI | XVII | XVIII | XIX | XX |
|---|---|---|---|---|---|---|
| Polyethylene DYLT | 3 | 3 | 2 | 2 | 3 | 3 |
| Piccotex 75 | 2.5 | 2.5 | 3.5 | 3.0 | 2.5 | 2.5 |
| Paraflint RG | 1.5 | 1.5 | 1.5 | 1.5 | 1.5 | 1.5 |
| Elvax 420 | .5 | .5 | .5 | 1.0 | .5 | .5 |
| DC Naphtha — ml | 20 | 20 | 20 | 20 | 20 | 20 |
| Bioloid Embedding Wax | 43 | 43 | 43 | 43 | 43 | 43 |
| Silica | .7 | .7 | .7 | .7 | .7 | .7 |
| Isopropal Alcohol — ml | 70 | 70 | 70 | 70 | 70 | 70 |
| Cyanoethylated Cellulose* | | | | | .14 | .7 |
| Draw Down Rod No. | 26 | 30 | 26 | 26 | 30 | 30 |

TABLE II-continued

| Example | XV | XVI | XVII | XVIII | XIX | XX |
|---|---|---|---|---|---|---|
| Light Sensitivity — f.c.s. | 0.18 | 0.27 | 0.22 | 0.16 | 0.20 | 0.16 |

*Available under the trade name Cyanocel from American Cyanamide Corp.

In all of the Examples except XX and XXI the imaging procedure of Example III is repeated. In Examples XX and XXI an uncoated film of Mylar is employed as a receiver. Small amounts of cyanolthylated cellulose is dispersed in the imaging layer to perform the same function as the dark charge injecting material of the previous examples employing Gantrez VC. A duplicate donor of Example XVI is imaged with an uncoated Mylar receiver but has higher background than obtained with the coated receiver. In all of the examples an excellent negative image is found on the receiver layer and a positive image is found on the donor layer.

Although specific components and proportions have been stated in the above description of preferred embodiments of the invention, other typical materials as listed above if suitable may be used with similar results. In addition, other materials may be added to the mixture to synergize, enhance or otherwise modify the properties of the imaging layer. For example, various dyes, spectral sensitizers or electrical sensitizers such as Lewis acids may be added to the several layers.

Other modifications and ramifications of the present invention will occur to those skilled in the art upon a reading of the present disclosure. These are intended to be included within the scope of this invention.

What is claimed is:

1. An imaging member comprising a donor layer and a receiver layer and sandwiched therebetween an integral electrically photosensitive imaging layer comprising electrically photosensitive materials and a thermo-activator for said imaging layer dispersed in an electrically insulating binder, said thermo-activator being a material different from the binder, and having a melting point lower than the binder so as to structurally weaken the cohesive strength of the imaging layer in response to heating, and sandwiched between the imaging layer and either the donor or receiver layer, layer of a dark charge injecting material, said dark charge injecting material being capable of injecting a uniform charge of one polarity into the electrically photosensitive imaging layer while under an electric field in the dark, and at least one of said donor and receiver layers being at least partially transparent to electromagnetic radiation to which said imaging layer is sensitive.

2. An imaging member of claim 1 wherein said thermo-activator comprises a paraffin wax.

3. The imaging layer of claim 1 wherein said receiver layer contacts the layer of dark charge injecting material.

4. The imaging member of claim 1 wherein said donor layer is transparent.

5. An imaging member of claim 1 wherein said imaging layer has dispersed therein hydrophobic silica in the form of a gel with the thermo-activator.

6. An imaging member of claim 1 wherein said imaging layer has dispersed therein a metal soap.

7. An imaging member of claim 6 wherein said metal soap is zinc stearate.

8. An imaging process which comprises the steps of:

1. providing an imaging member comprising a donor layer and a receiver layer and sandwiched therebetween an electrically photosensitive imaging layer comprising electrically photosensitive materials and a thermo-activator for said imaging layer dispersed in an electrically insulating binder, said thermo-activator being a material different from the binder, and having a melting point lower than the binder so as to structurally weaken the cohesive strength of the imaging layer in response to heating, and sandwiched between the imaging layer and either the donor or receiver layer, layer of a dark charge injecting material, said dark charge injecting material being capable of injecting a uniform charge of one polarity into the electrically photosensitive imaging layer while under an electric field in the dark, and at least one of said donor and receiver layers being at least partially transparent to electromagnetic radiation to which said imaging layer is sensitive;
2. heating said imaging member whereby said thermo-activator melts and renders said imaging layer structurally fracturable in response to the combined effects of an applied electric field and exposure to electromagnetic radiation to which said imaging layer is sensitive;
3. subjecting said imaging layer to an electrical field and exposing said imaging layer to electromagnetic radiation to which it is sensitive, and;
4. separating said donor and receiver layers while said member is subjected to said electrical field whereby said imaging layer fractures in imagewise configuration providing a positive image on one of said donor and receiver layers and a negative image on the other.

9. An imaging process of claim 8 wherein said thermo-activator is a paraffin wax.

10. An imaging process of claim 8 wherein said imaging layer is prepared in the absence of an organic nonpolar solvent.

11. The method of claim 8 wherein said heat is applied by means of contacting at least one of the donor and receiver layers with a heated element.

12. An imaging process of claim 8 wherein said donor layer is transparent.

13. An imaging process of claim 8 wherein said thermo-activator further includes a microcrystalline wax.

14. An imaging process of claim 8 wherein said receiver layer contacts the layer of dark charge injecting material.

15. An imaging process of claim 8 wherein said imaging layer is prepared by combining said electrically photosensitive material and binder material in said thermo-activator while said thermo-activator is in the melted state.

16. An imaging member comprising a donor layer and a receiver layer and sandwiched therebetween an electrically photosensitive imaging layer comprising electrically photosensitive materials, a thermo-activator for said imaging layer in combination with hydrophobic silica in the form of a gel, and a metal soap all dispersed in an electrically insulating binder, said thermo-activator being a material different from the binder, and having a melting point lower than the binder so as to structurally weaken the cohesive strength of the imaging layer in response to heating, and sandwiched between the imaging layer and either the donor or receiver layer, layer of a dark charge injecting material, said dark charge injecting material being capable of injecting a uniform charge of one polarity into the electrically photosensitive imaging layer while under an electric field in the dark, and at least one of said donor and receiver layers being at least partially transparent to electromagnetic radiation to which said imaging layer is sensitive.

* * * * *